US010945475B2

(12) United States Patent
Ponich et al.

(10) Patent No.: US 10,945,475 B2
(45) Date of Patent: Mar. 16, 2021

(54) MEDICAL GARMENTS AND ACCESSORIES WITH WELDED ELASTICIZED PARTS AND METHODS OF MANUFACTURE

(71) Applicant: PRIMED MEDICAL PRODUCTS INC., Edmonton (CA)

(72) Inventors: David Randall Ponich, Edmonton (CA); Joshua Alfred Eulert, Edmonton (CA); Enrico Wing Kei Fok, Edmonton (CA); Lucas Paul Ethier, Edmonton (CA)

(73) Assignee: PRIMED MEDICAL PRODUCTS INC., Edmonton (CA)

( * ) Notice: Subject to any disclaimer, the term of this patent is extended or adjusted under 35 U.S.C. 154(b) by 285 days.

(21) Appl. No.: 15/940,265

(22) Filed: Mar. 29, 2018

(65) Prior Publication Data

US 2019/0297973 A1 Oct. 3, 2019

(51) Int. Cl.

| | |
|---|---|
| ***A41D 27/24*** | (2006.01) |
| ***A41D 13/12*** | (2006.01) |
| ***A42B 1/04*** | (2021.01) |
| ***A62B 17/00*** | (2006.01) |
| ***A41D 31/02*** | (2019.01) |
| ***A41H 43/04*** | (2006.01) |
| ***A43B 3/16*** | (2006.01) |

(52) U.S. Cl.

CPC ..... *A41D 27/245* (2013.01); *A41D 13/129* (2013.01); *A41D 13/1209* (2013.01); *A41D 13/1236* (2013.01); *A41D 31/02* (2013.01); *A41H 43/04* (2013.01); *A42B 1/043* (2013.01); *A43B 3/163* (2013.01); *A62B 17/001* (2013.01); *A41D 2300/22* (2013.01); *A41D 2500/20* (2013.01); *A41D 2500/30* (2013.01)

(58) Field of Classification Search

CPC ..... A41D 27/194
USPC ..... 428/194
See application file for complete search history.

(56) References Cited

U.S. PATENT DOCUMENTS

| | | | | |
|---|---|---|---|---|
| 6,000,408 | A | 12/1999 | Maturaporn | |
| 6,622,312 | B2 | 9/2003 | Rabinowicz | |
| 2004/0238103 | A1 | 12/2004 | Cano | |
| 2007/0251636 | A1 | 11/2007 | Herbert | |
| 2011/0048077 | A1* | 3/2011 | Warren | A41B 9/001 66/176 |
| 2012/0035564 | A1* | 2/2012 | Otsubo | A61F 13/49017 604/370 |

(Continued)

*Primary Examiner* — Brent T O'Hern
(74) *Attorney, Agent, or Firm* — Field LLP

(57) ABSTRACT

A garment or accessory is provided having an elasticized portion, said elasticized portion being free of stitches or holes. The elasticized portion comprises a fabric portion of the accessory or garment to be elasticized; and a length of elastic element. The length of elastic element is applied to the fabric by a means selected from the group consisting of direct welding and indirect welding. A method is provided for elasticizing a fabric, said elasticized fabric being free of stitches or holes. The method involves providing a stack of fabric to be elasticized; stretching and positioning a length of elastic element against a first of the fabric in the stack; applying one or more ends of the elastic element to the fabric by a means selected from directly welding and indirectly welding; moving the first fabric to expose the next fabric in the stack to be elasticized; and repeating the steps for the next fabric.

13 Claims, 7 Drawing Sheets

(56) References Cited

U.S. PATENT DOCUMENTS

| | | | | |
|---|---|---|---|---|
| 2014/0130232 | A1* | 5/2014 | Farron | A41D 27/10 2/95 |
| 2015/0224738 | A1* | 8/2015 | Gallagher | B29C 65/5042 442/1 |

* cited by examiner

MEDICAL GARMENTS AND ACCESSORIES WITH WELDED ELASTICIZED PARTS AND METHODS OF MANUFACTURE

FIELD OF THE INVENTION

The present disclosure relates to fabrics and garments having welded elasticized parts, and methods of welding elastic elements to fabrics and garments or other non-woven fabric articles.

BACKGROUND OF THE INVENTION

The application of elastic elements to fabrics, both woven and non-woven, is a useful way of incorporating flexibility into the fabric and any garments or accessories made therefrom. The elastic allows for both gather and stretch of a material that may not otherwise have such elastic qualities.

In the case of garments and accessories, the addition of elastic elements can provide stretch to aid in donning the garment or accessory, to provide more flexibility in the size ranges that can be accommodated by a garment or accessory, and to provide cinching and gathering which aid in keeping the garment or accessory in place when donned.

Elastic elements are typically applied to garments and accessories by means of sewing the elastic element onto the fabric, or in some cases, sewing the elastic element into one or more folds of the garment. The elastic element is commonly stretched in one or more directions prior to being sewn, to then provide gathering of the garment or accessory when the elastic is allowed to return to its original, unstretched length or width. In this way the garment or accessory is gathered and can be extended by pulling on the now elasticized part of the fabric.

While sewing provides a secure means of affixing the elastic element to the fabric, sewing necessitates that the garment or accessory be pierced by a sewing needle. This in turn leads to holes in the fabric, regardless of how small. As such the initial integrity of the garment or accessory is compromised with each stitch.

In many industries and applications it is required that a fabric, or the garments made therefrom, be completely hole-free. This can be for the purposes of protection, hygiene and sanitation. One example of such garments are surgical and medical apparel such as gowns like surgical or isolation gowns and also medical accessories such as headwear like surgical or bouffant caps, shoe covers, etc. Another example of such apparel is in the field of personal protective apparel and apparel used by workers in cleanrooms. In such cases, it is preferred to have no holes in them whatsoever, to prevent or reduce contamination, spread of germs, particle shedding, etc.

As well, sewing can be time consuming. Even with state of the art industrial sewing machines, each stitch must be made individually and one after another, only the length of elastic to be affixed. Commonly, garments are sewn using a three-thread overlock stitch sewing style which provides some durability, but which inevitably takes time to apply. In a continuous stitching process, inconsistency in stitches is not unheard of, particularly if the garment or accessory being sewn becomes undesirably pulled or gathered by being pulled or pushed through the sewing machine. Furthermore, stitches and exposed gathering can be of considerable discomfort against the skin of a wearer, particularly since each wearer experiences a different degree of stretch and potential 'pinch' from the gathers.

U.S. Pat. No. 6,622,312 presents a garment assembled without sewing, in some cases the garments have elastic elements added to the trim in which the fabric is folded to encase the elastic element and then the folded fabric is ultrasonically welded to itself. The elasticized part is more typically a cuff or waist with an infinite band of elastic.

US 2007/0251636 teaches a garment having an elasticized portion which is formed without sewing. The document requires an adhesive element to be applied between the elastic element and the fabric.

US2004/023810 teaches a method of producing a garment with a seamless elastic trim. In this invention, the elastic, adhesive binding is itself heat welded to the fabric and seam is indicated as a temporary seam that dissipates with application of heat.

A need therefore exists to provide garments and accessories, and particularly those for use in the medical industry, having elasticized parts that create no holes in the barrier fabric. A need further exists of methods of manufacturing such garments accessories in an efficient and quality-consistent manner, without making holes therein.

SUMMARY

A garment or accessory is provided having an elasticized portion, said elasticized portion being free of stitches or holes. The elasticized portion comprises a fabric portion of the accessory or garment to be elasticized; and a length of elastic element. The length of elastic element is applied to the fabric by a means selected from the group consisting of direct welding and indirect welding.

A method is provided for elasticizing a fabric, said elasticized fabric being free of stitches or holes. The method involves providing a stack of fabric to be elasticized; stretching and positioning a length of elastic element against a first of the fabric in the stack; applying one or more ends of the elastic element to the fabric by a means selected from directly welding and indirectly welding; moving the first fabric to expose the next fabric in the stack to be elasticized; and repeating the steps for the next fabric.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

A further, detailed, description of the invention, briefly described above, will follow by reference to the following drawings of specific embodiments of the invention. The drawings depict only typical embodiments of the invention and are therefore not to be considered limiting of its scope. In the drawings.

Figure 1:
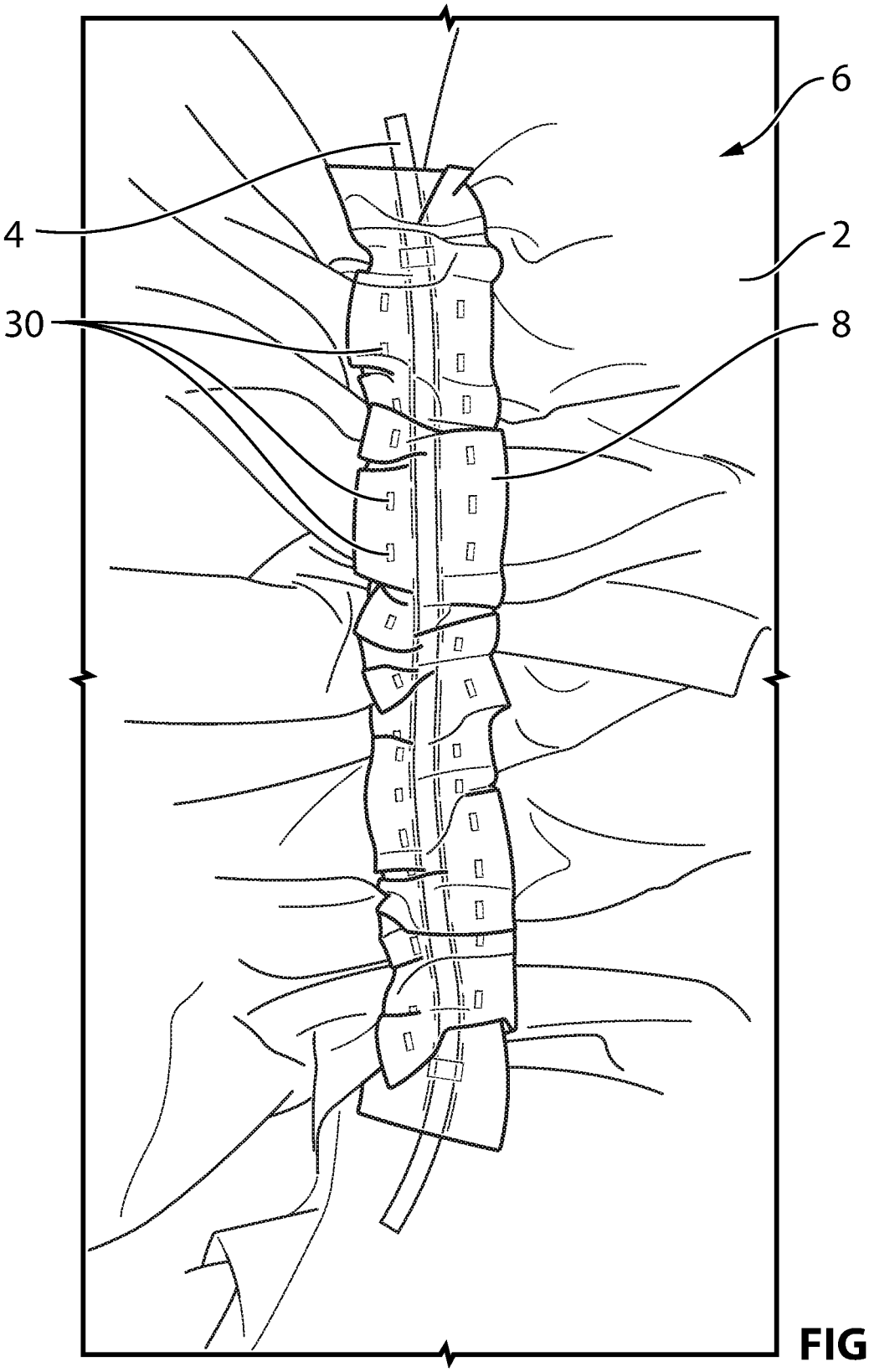
FIG. 1 is a perspective view of one embodiment of the present invention, showing a fabric having an elastic element at least partially covered by a cover piece, wherein the cover piece is welded to the fabric along the length of the cover piece and wherein both the elastic element and the cover piece are welded to the fabric at the ends of the cover piece.
Figure 2A:
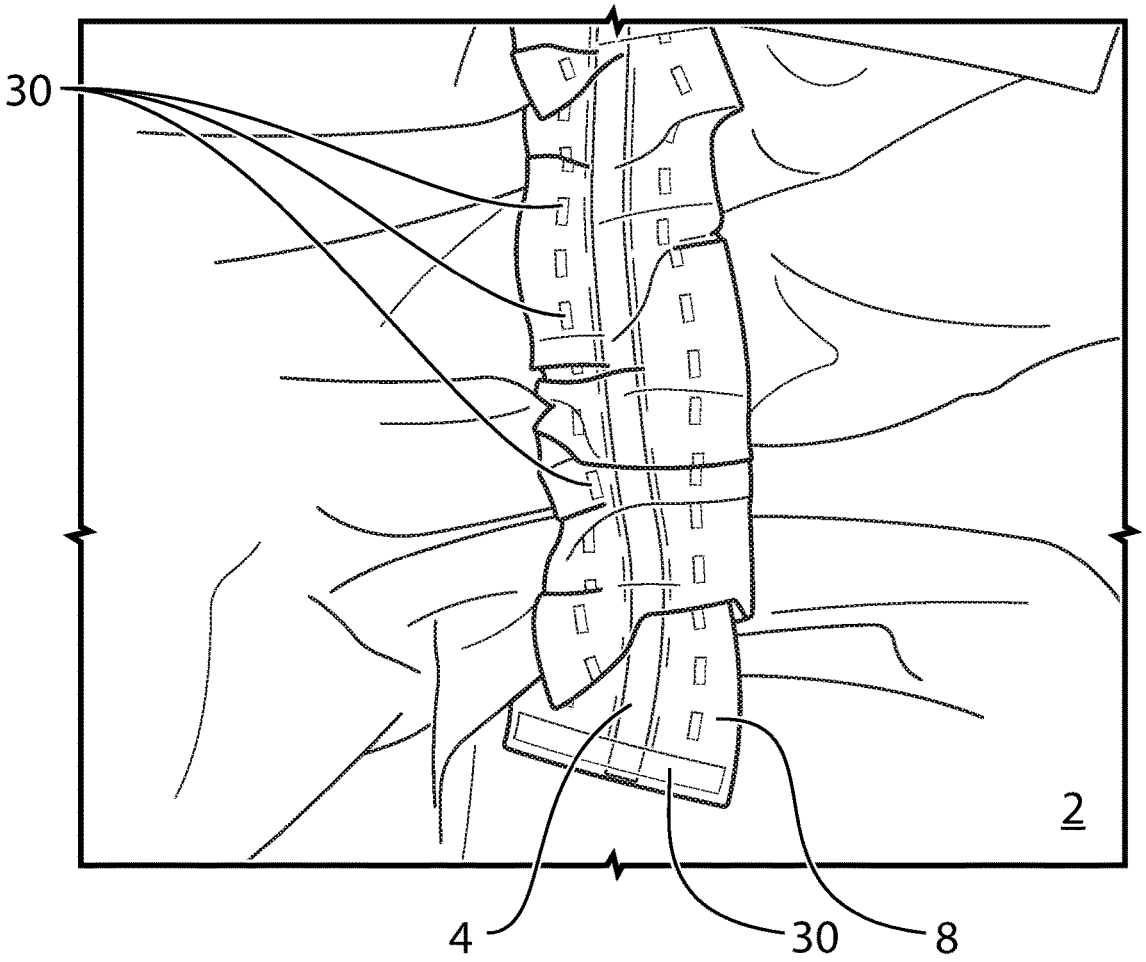
FIG. 2*a* is a close up perspective view of FIG. 1.
Figure 2B:
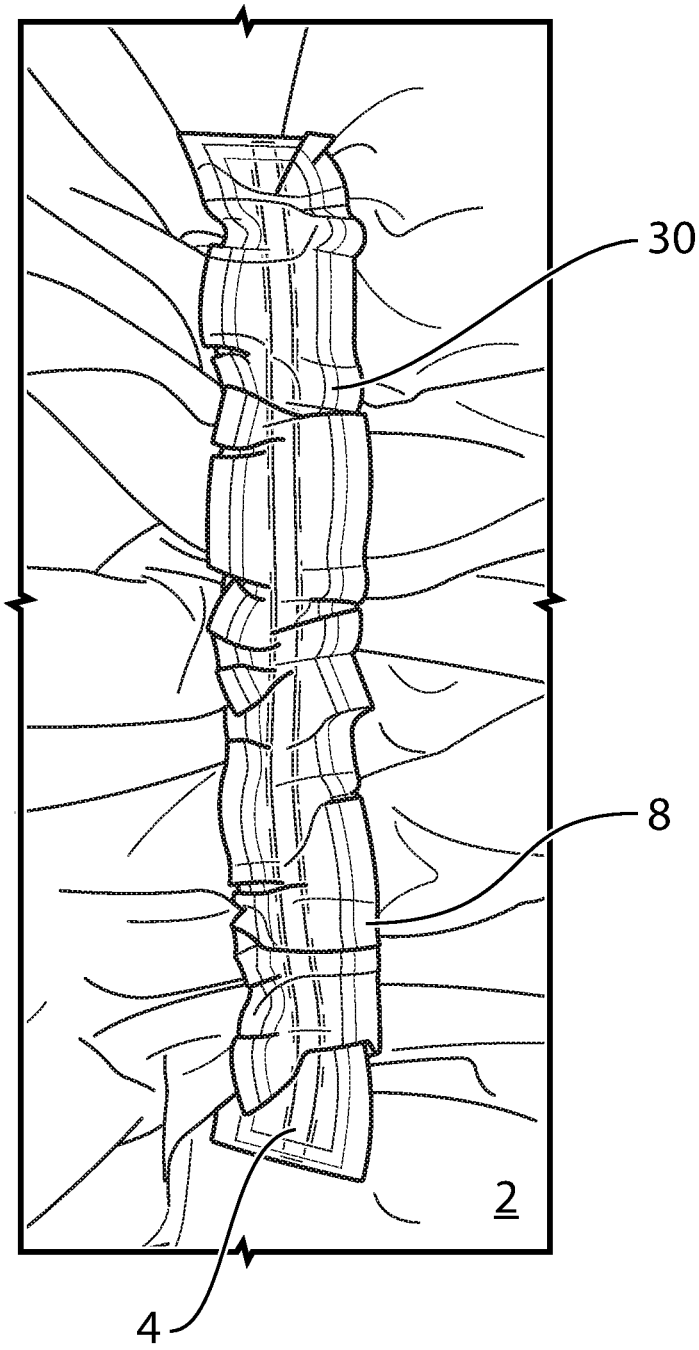
FIG. 2*b* is an alternate embodiment of FIG. 2*a* with a continuous weld.
Figure 3:
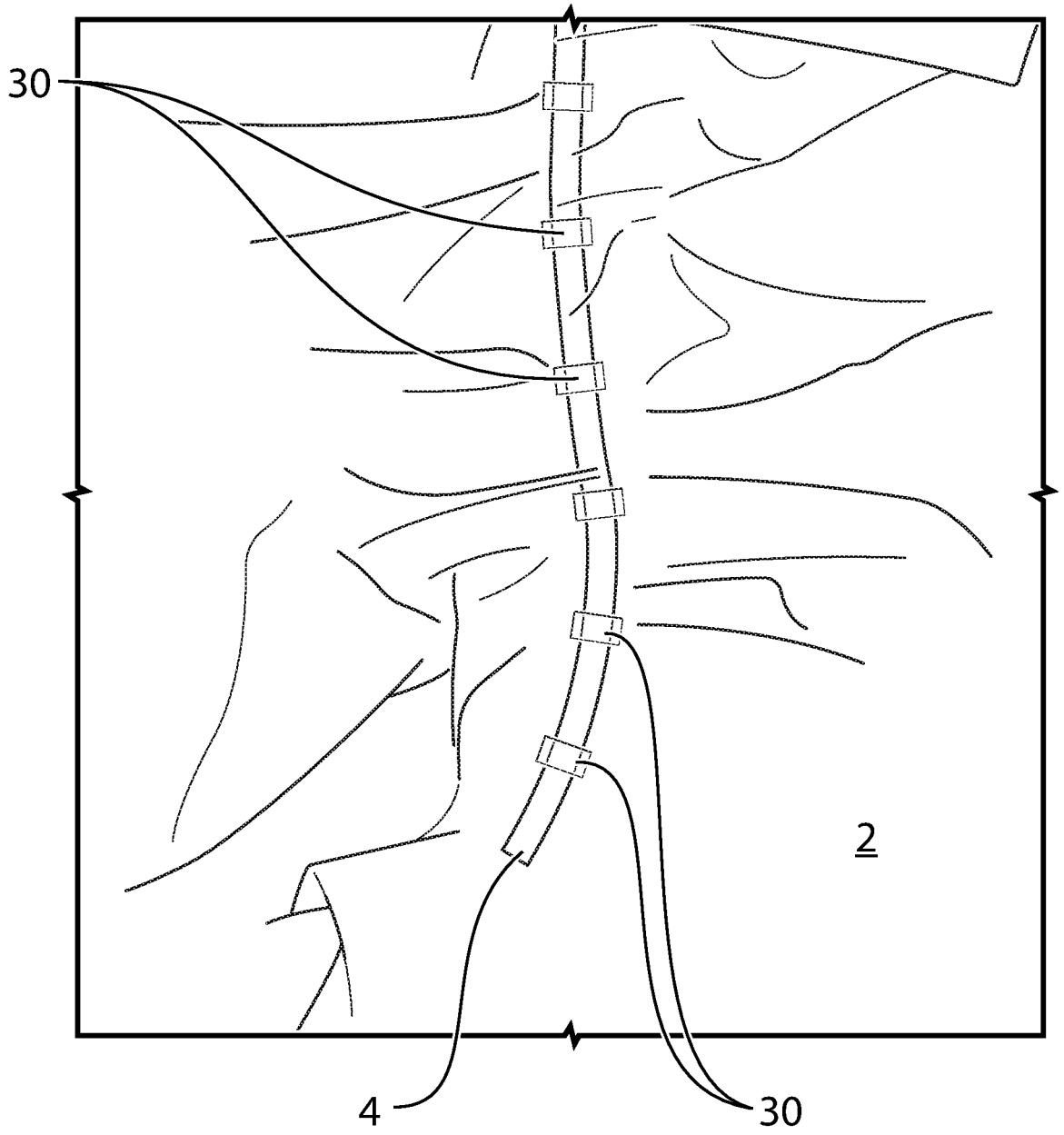
FIG. 3 is a close up perspective view of a further embodiment of the present invention, wherein the elastic element is directly welded to the fabric with no cover piece.
Figure 4A:
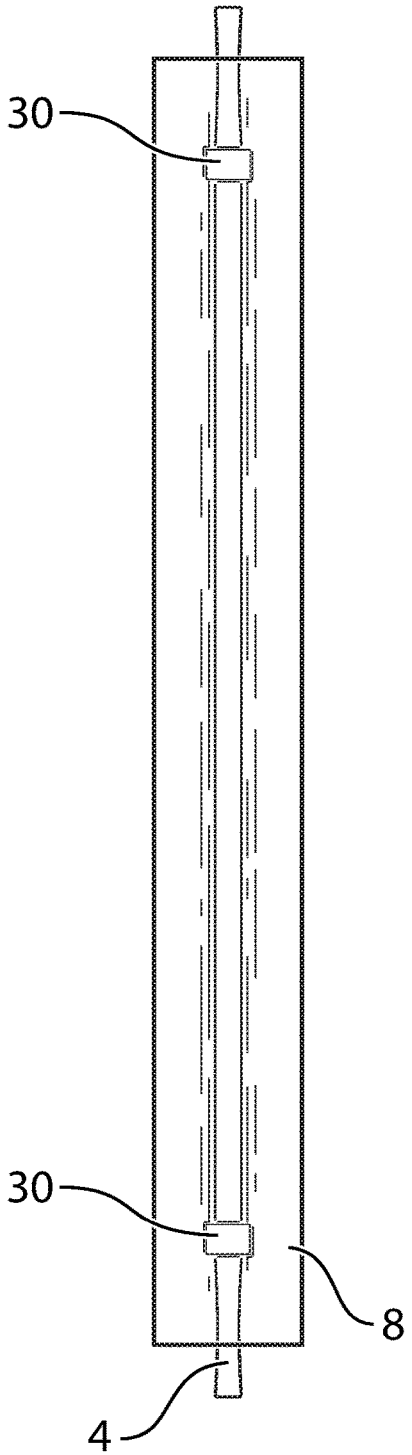
FIG. 4*a* is a close up perspective view of a section of cover piece with a section of elastic element welded thereto at either end, prior to welding to the fabric.
Figure 4B:
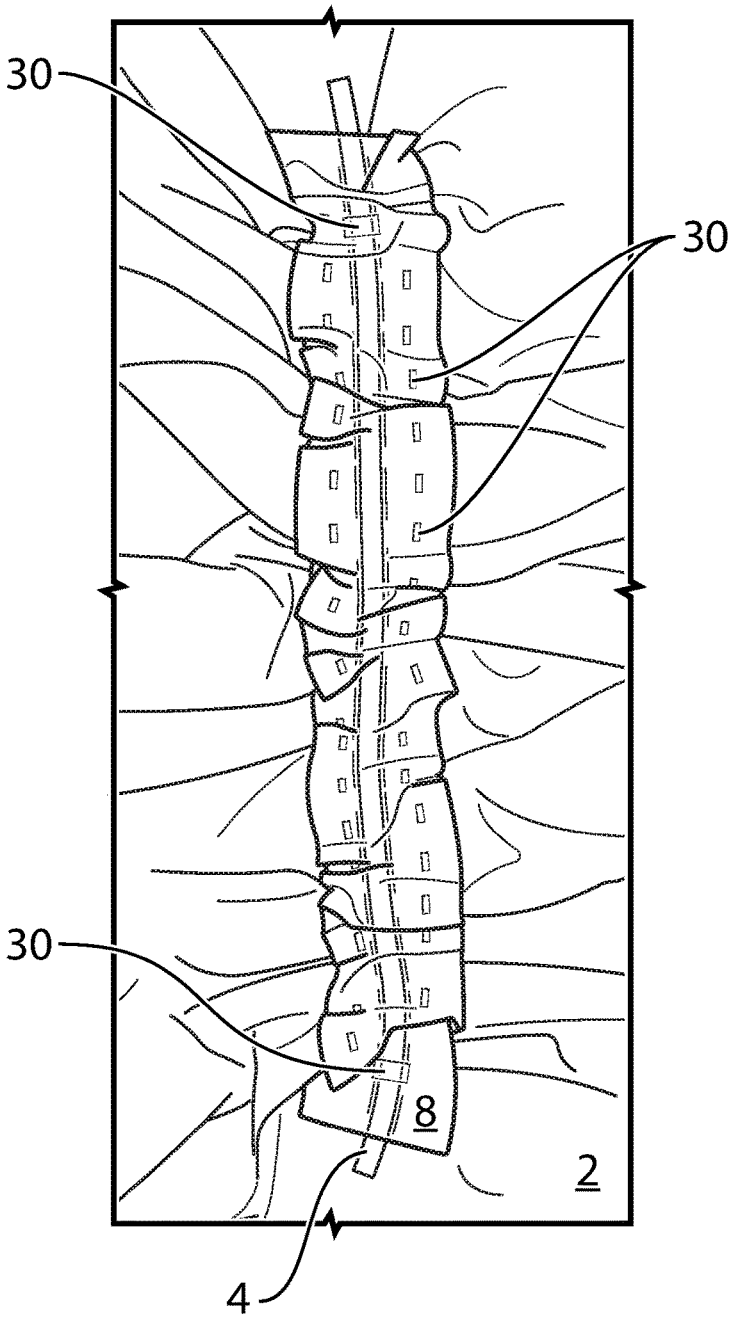
FIG. 4*b* is a close up perspective view of the cover piece and welded elastic element of FIG. 4*a*, now welded to fabric.
Figure 5:
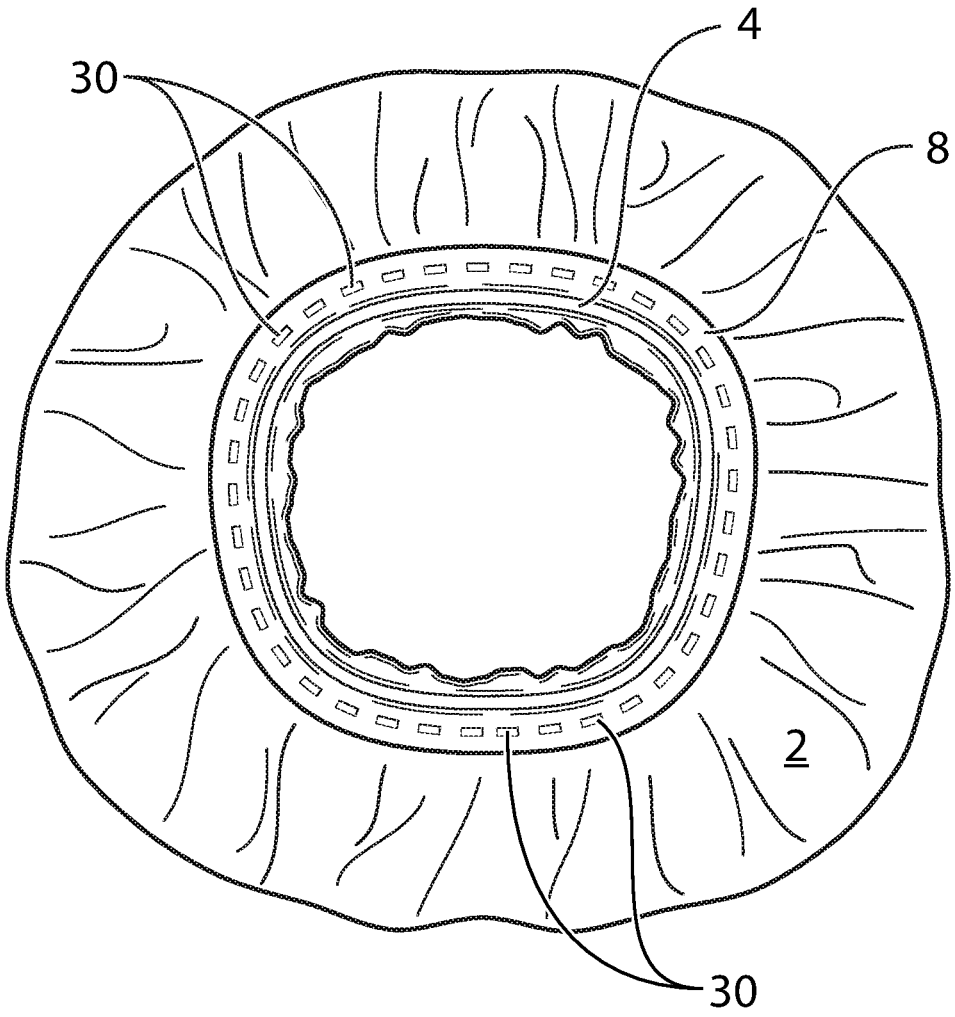
FIG. 5 is an end view of an example of a fabric sleeve with an elastic element loop and a welded cover piece loop overtop.
Figure 6:
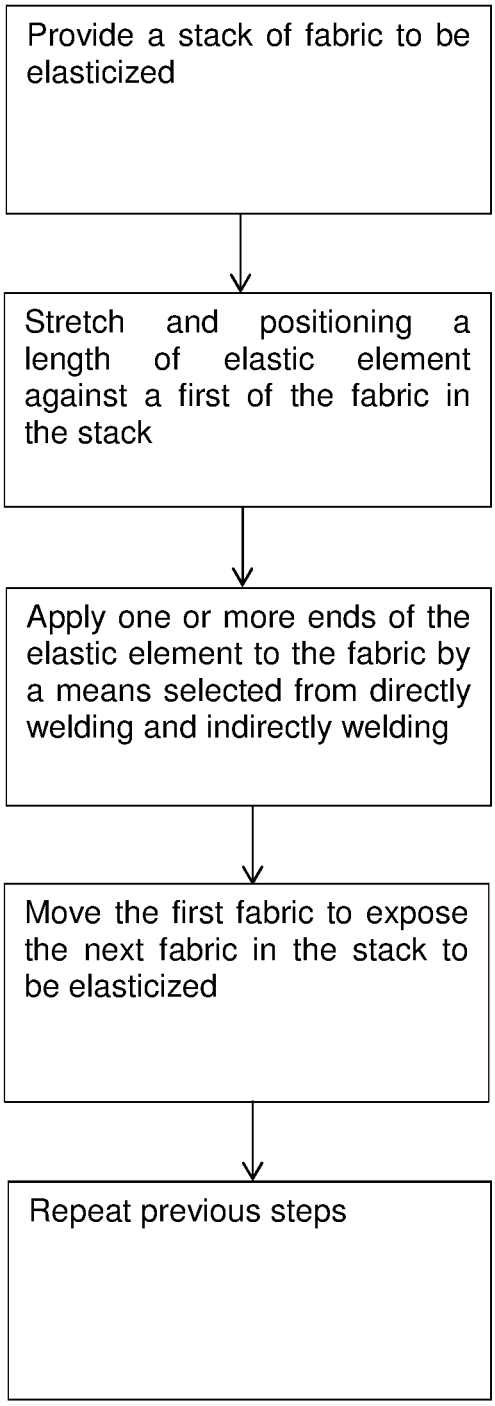
FIG. 6 is a schematic diagram of a method of the present invention.

The drawing is not necessarily to scale and in some instances proportions may have been exaggerated in order more clearly to depict certain features.

DETAILED DESCRIPTION OF VARIOUS EMBODIMENTS

The description that follows and the embodiments described therein are provided by way of illustration of an example, or examples, of particular embodiments of the principles of various aspects of the present invention. These examples are provided for the purposes of explanation, and not of limitation, of those principles and of the invention in its various aspects.

The present disclosure presents accessories and garments comprising one or more elasticized parts in which the garment or accessory is free of holes with respect to the application of elastic elements to the fabric. The present disclosure also provides methods of applying elastic elements to garments or accessories by welding.

In the present case accessories and garments can included any number of types of apparel, including, but not limited to medical apparel, medical accessories such as headwear like surgical or bouffant caps, shoe covers, personal protective apparel and apparel used by workers in cleanrooms. More preferably, the garments related to the present invention are medical gowns such as surgical or isolation gowns.

For the purposes of the present invention, the term fabric is considered to cover any woven or non-woven material, which can include non-woven polymer or plastic blends.

In particularly preferred embodiments, the fabric can be any one of a spunbond-meltblown-spunbond material, polyethylene films, spunbond polypropylene materials, and other non-woven materials including laminates of films and non-wovens. The present invention also applies to woven articles treated or laminated to provide a barrier function. It will be understood that any material presenting a barrier function for industrial or medical purposes falls within the definition of the term fabric for the purposes of the present invention.

In a more preferred embodiment the fabrics are used in the manufacture of garments and accessories for medical purposes such as isolation gowns, surgical gowns, personal protective gowns, cleanroom apparel, shoe covers, caps, hair and head covers and others. In such applications where maintaining a sterile environment is crucial, it is very important to avoid puncturing the gown in any way. Maintaining the integrity of the gown prevents entry of fluids, contaminants, hazardous substances, germs etc. In one example, the apparel can be biohazard suits or gowns which are required to avoid viral or bacterial exposure. In another example, it may be required to contain particles, such as skin particles, shed from the wearer, and to keep these isolated from the surrounding environment.

While the present description may refer to such medical gowns and accessories and parts thereof, it would be understood by a person of skill in the art that the present invention can be applied to any number of other garments or fabric in general without departing from the scope of the invention.

With reference to the Figures, the fabric 2 of a garment or accessory is provided with an elastic element 4 that is bonded to the fabric 2. Preferably, the bonding is done by welding such as heat welding or ultra-sonic welding. Bonding may also include adhering the elastic element 4 by means of glue and the like. Most preferably, the bonding is done by ultrasonic welding.

Sonic welding, or ultrasonic welding, is a process by which ultrasonic vibrations are locally applied to one or more materials to be held together under pressure to create a solid-state weld. The vibrations are typically high-frequency vibrations. Ultrasonic welding is particularly effective in joining materials of dissimilar characteristics together. There is no application of adhesive, but rather the material is softened and "melted", just as in welding, at the location to which the high frequency vibration is applied, and then can be pressed together with other materials to form the weld.

Such welding leads to no puncturing of the fabric to be elasticized. A lack of holes or punctures in the fabric or garment is important in that it helps maintain the fluid resistance of the fabric or garment around the elasticized part. Furthermore, the lack of holes or punctures can also enhance other properties like thermal characteristics, the ability to serve as a gas/vapour barrier, and the ability to serve as a microbial/viral barrier.

Furthermore, the process of welding an elastic element 4 to the fabric 2 can be done in one step, one application of ultra-sonic vibrations along the length or width of weld 30 desired. This leads to a more uniform, even application of the elastic element 4 and less chance of pulling, gathering or tearing of the fabric 2. This is contrary to sewing in which the fabrics are sewn stich-by-stich along the length or width of the fabric.

More preferably, the fabric 2 with elasticized part 6 comprises the elastic element 4 and optionally a cover piece 8 over top of the elastic element 4. The cover piece 8 can be optionally welded directly to the fabric 4 to thereby form a sleeve or cover to the elastic element 4, which is located between the cover piece 8 and the fabric 2. The cover piece 8 may be welded one or more sides to the fabric, but need not be welded on all sides thereof. While the cover piece 8 is shown in the figures as covering the elasticized part 6, it would be well understood that the cover piece could extend beyond the elasticized part 6 as well.

The cover piece 8, preferably serves to weld 30 to the fabric 2, and hold the elastic element 4 in place, without welding extensive portions of the elastic element 4 needing to be welded.

The cover piece 8 may also be welded to fabric 2 in such a way that elastic element 4 is fully covered by the cover piece 8 such that the elastic element is prevented from contacting a wearer's skin.

The elastic element 4 is preferably stretched to at least some extent prior to application to the fabric, and is welded to the fabric 2, either directly or through the cover piece 8, at each end 4*a*, 4*b* thereof. In this way the elasticity of the elastic element 4 is not altered by welding, and there is very little welded portion of the elastic element 4 in which the elasticity could be compromised. It should be noted that ultrasonic welding may or may not, or may only very slightly, alter or diminish the elasticity of the elastic element 4, but in the present invention, limited the welding of the elastic element 4 to either the fabric 2 or the cover piece 8 further reduces such chances.

However, it would be understood by a person of skill in the art that it is also possible for the elastic element 4 to be directly welded to the fabric 2 with or without any cover piece 8 at all. In such cases, the elastic element 4 can be welded along its entire length directly to the fabric 2, or may be welded at intervals along the length of the elastic element 4, with or without the cover piece 8.

In a further embodiment, it is possible to pre-weld the elastic element 4 to the cover piece 8 and then weld 30 the cover piece 8 with the elastic element 4 to the fabric 2.

The elastic element 4 can be an elastic band or cord, or an elastic webbing material.

In yet a further embodiment, it is also possible to entirely encase the elastic element 4 within the cover piece 8 that then weldable to the fabric 2. For example, the elastic element can be looped and affixed to itself, and not bonded to either the fabric 2 or to the cover piece 8, but rather held by the cover piece 8 against the fabric 2, the thereby gather the fabric 2.

Some embodiments of the present elasticized fabric or garment 2 further provide an adhesive element that can be adhesive glue or an adhesive tape 20 either as an alternative to or in conjunction with ultrasonic welding to affix the elastic element 4 to the fabric. In such cases the adhesive tape 20 may be applied along the entire length of the elastic element, or may be applied at intervals along the length of the elastic element, with or without the cover piece 8. In a case where the cover piece 8 is used, the adhesive tape 20 could optionally only be applied at each end 4*a*, 4*b* of the elastic element as an alternative to or in conjunction with ultrasonic welding of the elastic elements ends 4*a*, 4*b* to the fabric or garment 2.

In one embodiment, a process of the present invention involves welding of an elastic element to a fabric medical garment or accessory. More preferably, the present method is at least partly automated to allow for the application of elastic elements 4 to several pieces of fabric 2 or medical garments or accessories one after another in succession.

The process involves first providing a stack 10 of fabric 2, in process garments or garment parts a portion of which is to be elasticized, to an automatic welding machine 12. The machine comprises a source 14 of the elastic element 4, preferably on a spool or other means for storing and dispensing the elastic element 4, and gripping means 16 for repeatedly gripping and stretching a length of the elastic element 4 and positioning it against the fabric or garment 2. The machine 12 will also optionally comprise a source 18 of cover piece 8, again preferably a spool, roll or other means for storing and dispensing the cover piece 8, and gripping means 22 for repeatedly gripping a length of the cover piece 8 and positioning it over the elastic element 4.

The machine 12, as a welding machine, will comprise all of the elements known in the art for ultrasonic or heat welding. The machine 12 will further comprise separate means for cutting the lengths of the elastic element 4 and optionally also the cover piece 8 from the sources 14, 18 thereof, and a means for engaging the elasticized fabric 6 or garment and moving it to expose the next fabric 2 or garment in the stack 10 to be elasticized.

In operation, the present welding machine 12 can simultaneously stretch and position a length of elastic element over the fabric 2 and optionally grip and position a length of the cover piece 8 over the length of the elastic element. Then the welding machine can simultaneously apply the elastic element 4 to the fabric 2, either by direct welding or optionally by welding the cover piece 8 to the fabric 2, and weld 30 at least one end 4*a*, 4*b* of the length of elastic element 4 to the fabric 2. Next the welding machine cuts the length of the elastic element 4 and optionally also the cover piece 8 from the sources 14, 18 thereof and moves the elasticized fabric or garment out of the stack 10 to expose the next fabric or garment to be elasticized.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

The invention claimed is:

1. A garment or accessory having an elasticized portion, said elasticized portion being free of stiches or holes, the elasticized portion comprising:

a. a fabric portion of the accessory or garment to be elasticized; and b. a length of elastic element applied to the fabric portion by ultrasonic welding, wherein the garment is selected from the group consisting of medical gowns, surgical gowns, isolation gowns, personal protective apparel, cleanroom apparel, biohazard suits and biohazard gowns and wherein the accessory is selected from the group consisting of medical headwear, hair covers, head covers, surgical caps, bouffant caps and shoe covers.

2. The garment or accessory of claim 1, wherein at least one end of the length of elastic element is welded directly to the fabric.

3. The garment or accessory of claim 2, further comprising a cover piece ultrasonically welded to the fabric portion to cover at least a portion of the elastic element.

4. The garment or accessory of claim 3, wherein the cover piece covers an entirety of the elastic element.

5. The garment or accessory of claim 3, further comprising an adhesive element for adhering at least a portion of the elastic element to the fabric portion.

6. The garment or accessory of claim 5, wherein adhering of at least a portion of the elastic element to the fabric portion by the adhesive element is in addition to direct welding of the elastic element to the fabric portion.

7. The garment or accessory of claim 5, wherein the adhesive element is selected from the group consisting of adhesive glue and adhesive tape.

8. The garment or accessory of claim 3, wherein the cover piece is a part of the fabric of the garment or accessory, folded on itself.

9. The garment or accessory of claim 1, wherein the fabric is selected from the group consisting of woven material, non-woven material.

10. The garment or accessory of claim 9, wherein the non-woven material is selected from the group consisting of polymer blends, plastic blends, spunbond-meltblown laminate materials, polyethylene films, spunbond polypropylene materials, and laminates of films and nonwovens.

11. The garment or accessory of claim 9, wherein the woven material is selected from the group consisting of treated woven articles and laminated woven articles that provide a barrier function.

12. A garment or accessory having an elasticized portion, said elasticized portion being free of stiches or holes, the elasticized portion comprising:

a. a fabric portion of the garment or accessory to be elasticized;

b. a cover piece having an elastic element ultrasonically welded thereto;

wherein the cover piece with the elastic element ultrasonically welded thereto is ultrasonically welded to the fabric portion, wherein the garment is selected from the group consisting of medical gowns, surgical gowns, isolation gowns, personal protective apparel, cleanroom apparel, biohazard suits and biohazard gowns and wherein the accessory is selected from the group consisting of medical headwear, hair covers, head covers, surgical caps, bouffant caps and shoe covers.

13. A garment or accessory having an elasticized portion, said elasticized portion being free of stiches or holes, the elasticized portion comprising:

a. a fabric portion of the accessory or garment to be elasticized;

b. a length of elastic element having at least one end, wherein the at least one end of the length of elastic element is welded directly to the fabric portion by ultrasonic welding; and c. a cover piece welded to the fabric portion by ultrasonic welding to cover an entirety of the elastic element, wherein the garment is selected from the group consisting of medical gowns, surgical gowns, isolation gowns, personal protective apparel, cleanroom apparel, biohazard suits and biohazard gowns and wherein the accessory is selected from the group consisting of medical headwear, hair covers, head covers, surgical caps, bouffant caps and shoe covers.

* * * * *